US005716271A

United States Patent [19]

Paidosh

[11] Patent Number: 5,716,271

[45] Date of Patent: Feb. 10, 1998

[54] MAGNETIC LATCH FOR EXHAUST VENT

[76] Inventor: Richard L. Paidosh, 3452 Silver La., St. Anthony, Minn. 55421

[21] Appl. No.: 748,393

[22] Filed: Nov. 13, 1996

Related U.S. Application Data

[60] Provisional application No. 60/006,986, Nov. 20, 1995.

[51] Int. Cl.[6] ..... F24F 13/10

[52] U.S. Cl. ..... 454/359; 137/527.8; 454/904

[58] Field of Search ..... 454/353, 359, 454/360, 904; 137/527, 527.8

[56] References Cited

U.S. PATENT DOCUMENTS

| | | | |
|---|---|---|---|
| 2,739,521 | 3/1956 | Spear . | |
| 3,250,206 | 5/1966 | Strouth | 454/359 |
| 3,541,945 | 11/1970 | Wexler | 454/359 |

FOREIGN PATENT DOCUMENTS

| | | | |
|---|---|---|---|
| 60-161214 | 8/1985 | Japan | 454/904 |

*Primary Examiner*—Harold Joyce
*Attorney, Agent, or Firm*—William B. Barte

[57] ABSTRACT

A latch for use with a valve on the end of an exhaust vent typically associated with a clothes dryer or the like. The latch includes a flat, plastic bonded magnet having a layer of pressure sensitive adhesive (PSA) for bonding the magnet to one of either the hinged valve plate or stationary face plate of the valve while a strike plate formed of a conformable, magnetically susceptible material is bonded by a PSA layer to an opposing section of the other of the valve plate or face plate. The latch is kept closed by magnetic forces in the absence of blower expelled air, regardless of variations in pressure on the valve plate, such as may result from gusts of wind.

10 Claims, 2 Drawing Sheets

MAGNETIC LATCH FOR EXHAUST VENT

This application claims the benefit of U.S. Provisional Application Ser. No. 60/006986 filed on Nov. 20, 1996.

BACKGROUND OF THE INVENTION

1. Field of the Invention

This invention relates to venting apparatus of the type typically used to exhaust air from appliances such as clothes dryers, cooking ranges and ovens, and humid areas such as bathrooms and the like.

2. Description of Related Art

Nearly all gravity type air vents presently in use utilize what may be termed a flap valve which includes a face plate having on a first side an inlet for admitting air expelled from a blower and on a directly opposite second side at least one pivotally mounted valve plate. The valve plate(s) is moveable to open and close the vent, being opened by the pressure of blower expelled air and being closed by gravity when the blower is inoperative and no air is being expelled.

As, for example, described in U.S. Pat. No. 2,739,521 (Spear) and U.S. Pat. No. 3,541,945 (Wexler), gravity type flap valves, however suffer from the disadvantage of being highly susceptible to intermittently severe and annoying valve clatter due to varying atmospheric pressure caused by gusts of wind outside the vent when the blower is inoperative. This clatter results from gusts of wind which first create a lower pressure on the outside face of the valve plate than that present on the inside face. The pressure differential forces the valve plate to at least partially open to permit pressure equalization. As soon at the pressure does equalize, which occurs very quickly, the valve plate drops back to its closed position with an attendant seating noise, and thereby again sets up the conditions for a valve opening pressure differential. This cycle, of course, repeats rapidly, resulting in the aforedescribed clattering action and noise whenever wind gusts of sufficient intensity occur.

These patents further note that previous attempts to overcome such undesirable chattering involving weights and springs acting on the valve plate have been unsatisfactory because the weakest closing force thus provided occurs precisely at the time when the strongest closing force is needed, namely when the blower is inoperative and the valve is closed. Even worse, such closing force the progressively increases as the valve opens, so that blower expelled air must now overcome the increasing force acting on the valve plate in order to keep the valve open. This, in turn reduces the air discharge efficiency of the unit and may require the use of a larger blower motor to increase the air flow, at an attendant increase in energy consumption.

To avoid the unsatisfactory results thus caused by the use of springs or weights, the patents propose to use latches based on magnetic attractive forces. By so doing, they both note that the clattering problem is effectively solved, as magnetic forces provide maximum closure force when the valve is closed, and negligible closure force when the valve is open under the influence of blower expelled air. Such magnetically based latches take advantage of the fact that substantially higher valve opening pressure differentials are created by blower expelled air than arise from even very severe wind gusts. In such a latch, of course,the magnetic holding force must be chosen to be sufficiently high to prevent the latch from opening due to such wind conditions, while still allowing the latch to open in the presence of blower expelled air.

Magnetically based valves are further noted to be superior in that when the blower is started, a considerable static head is built up in the duct leading to the vent, which head is sufficient to overcome the magnetic holding force so that the valve plate is readily rotated to its open position. As soon as it has so rotated even a short distance, the magnetic force becomes negligible, and by the time it becomes fully open, the force is so minute that even the small dynamic head present during continuous blower operation is sufficient to keep the valve open.

SUMMARY OF THE INVENTION

The aforenoted disclosures of magnetically based closure mechanisms, while differing somewhat in specific constructional details are alike in that both require the use of magnetic members permanently secured to the vent housings, such as by rivets, welds and the like. As such, the mechanisms can only realistically be provided at the time the vents themselves are manufactured, and thereby add a cost not willingly borne by purchasers not immediately perceiving any need for such closures.

In contrast, the latch of the present invention, while also being based on magnetic attraction principles, utilizes an extremely simple construction readily and primarily used in an after-market context. In such a context, the latch may be preferably installed by a home owner, tenant and the like in an already installed vent, when the problem of valve clatter or heat loss is recognized.

The latch of the present invention is thus designed for use with an exhaust vent which includes a fixed face plate, on one side of which is an inlet for admitting air expelled from a blower, and on a directly opposite side is an air exhaust outlet for discharging such air into an outside atmosphere and a valve for controlling the passage of air through the vent. In this invention, the valve comprises at least one hingedly suspended valve plate operatively coupled to the exhaust outlet. The valve plate has an inside and an outside face, with the inside face presenting toward the fixed face plate. The valve is closed by moving the valve plate against the fixed face plate in the absence of blower expelled air, and with the outside face communicating with the outside atmosphere.

Specifically, the latch comprises at least one substantially flat plastic bonded magnet having a first face to which is bonded a layer of pressure sensitive adhesive and having an opposite second face for magnetic interactions, and an associated strike plate formed of a thin strip of a conformable magnetically susceptible material having a first portion to which is bonded a layer of pressure sensitive adhesive material, and having a second portion adapted to be magnetically engageable with and separable from the second face of the magnet.

The first portion of the strike plate is adapted to be deformed to match the contour of either the face plate or valve plate, and to be secured thereto by means of the pressure sensitive adhesive carried on the first portion. When so secured, the second portion is positioned out of the primary airstream. The magnet is adapted to be secured to the other of the valve plate or fixed face plate and to be appropriately positioned thereat by first magnetically coupling the second face of the magnet and second portion of the strike plate together. The other of the fixed face plate or valve plate is then brought into contact with the adhesive carried on the magnet, thereby causing the other of the fixed face plate or valve plate to be secured to the magnet while ensuring that the magnet and strike plate are optimumly located with respect to magnetic attraction forces.

The latch employing such magnetic forces is thus operative in the absence of blower expelled air to hold the valve in its closed position regardless of variations in pressure to which the said outside face of the valve plate may be subjected, such as may be due to gusts of wind and the like. Such gusts create a differential pressure which is manifested as an impulse torque on the valve plate. The increased mass provided to the valve plate by the magnet or striker plate and an attendant increase in the moment of inertia, in combination with the magnetic forces, thus requires a still greater impulse torque associated with more intense gusts before the valve will inadvertently open. At the other extreme, the magnetic forces are sufficiently low as to be inoperative to hold the valve closed in the presence of blower expelled air.

In a preferred embodiment, the latch of the present invention may include a magnet magnetized to include plurality of alternating magnetic poles. The magnet may also include a strip of magnetically responsive material secured to the first face of the magnet, and to the outer face of which the layer of pressure sensitive material is bonded.

Also, to facilitate handling and temporary positioning, the outer surfaces of the adhesive layers carried by the magnet and associated strike plate are preferably provided with release liners. Such adhesive layers may typically comprise a strip of pressure sensitive adhesive tape having adhesive on both sides of a substrate, the adhesive on one side thereby securing the tape to the respective latch member.

In one embodiment, the magnet is adapted to be adhered to a relatively planar surface of the face plate out of the airstream, while the strike plate is adapted to be bent to conform to the configuration of the valve plate and to extend therefrom to contact the magnet where it is adhered to the face plate, thereby minimizing the mass added to the valve plate. Alternatively, the second portion of the strike plate may be adapted to be bent back on itself and to be maintained thereat by the pressure sensitive adhesive layer, thereby allowing the valve plate to be positioned therebetween.

DETAILED DESCRIPTION

Figure 1:
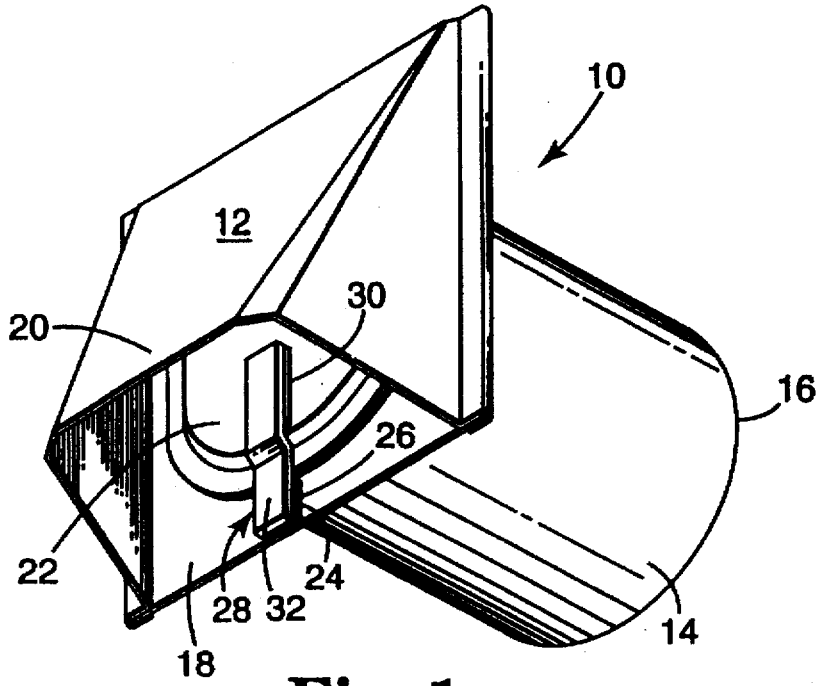
FIG. 1 is a perspective view of the exhaust vent of the present invention showing the novel magnetically based valve in its closed position.

One embodiment of the exhaust vent latch of the present invention is shown in the perspective view of FIG. 1 as used with a typical clothes dryer vent 10. Such a vent 10 includes a housing 12, an inlet duct 14 a free end 16 of which is adapted to be coupled to the exhaust outlet of a dryer or the like. The inlet duct terminates at an opening on the front side of a fixed face plate 18. A protective hood 20 is also provided, being secured along its vertical and top edges to the face plate 18 and sloping downwardly and outwardly to provide space within for a hingedly supported valve plate 22. The valve plate 22 is mounted along its top edge via a hinge (not shown in FIG. 1) to the top of the face plate 18 opposite that to which the duct 14 is secured.

Gravitational forces thus cause the valve plate 22 to cover the opening through the face plate 18 when in its closed position. In order to releasably retain the valve plate 22 in its closed position and to positively close and hold it so closed in the absence of blower expelled air, thereby withstanding the aforenoted clattering caused by gust of wind, the vent 10 further includes a magnetic latch comprising a permanent magnet 24 and an associated striker plate 28. The magnet 24 is secured to the face plate 18 below the opening therethrough via a layer of pressure sensitive adhesive 26, so as to be out of the primary airstream. Similarly, the striker plate 28 is secured to the valve plate 22 via another layer of pressure sensitive adhesive 30, with a portion 32 of the striker plate extending beyond the valve plate so as to contact the magnet 24 when the valve plate is in its closed position.

The magnet 24 is selected to have sufficient force to positively hold the portion 32 of the valve plate 22 as that plate reaches its closed position without any clattering due to wind gusts and the like, and to so releasably retain the valve plate in the closed position, while at the same time to have insufficient force so that it does not prevent opening of the valve plate when air is expelled therethrough by an associated blower.

It should be further appreciated that as the valve plate moves away from the magnet 24 toward its fully open position, the magnet exerts virtually no force on the projecting portion 32 of the striker plate 28, so that there is no effect on the resistance of the valve plate to the passage of air thereby. In this respect, the magnetic latch differs sharply from the prior use of weights or springs to close and maintain closed otherwise similar, gravity based flap valves. The closing forces exerted by such weights and springs are the weakest when the valve plate is in the closed position, and increase as the plate is opened. Accordingly, such valves offer increased resistance to the continuing opening of the valve plate by air expelled therethrough, and thus reduce the efficiency of the vent by imposing a back-loading pressure upon the blower associated with the vent. The magnet requirements for such a latch may be calculated as follows: A rough measurement of a typical valve plate was determined to be about 3 inches, thus having a surface area of about 7.1 square inches. If one further assumes an average air pressure of about 15 psi, the force applied to such an area is about 106 lbs. (P=FA) With the plate hanging in a vertical position, gravitational forces are negligible, so that for the flap to remain in the closed position, a like force must be placed on the inside surface, and with no wind blowing, the plate will remain closed. But a small gust of wind can reduce the outside pressure, resulting in a pressure differential across the valve plate. Assuming such differential to be 0.05 atmos., the force on the outside will be seen to drop to about 100 lbs., and such an unbalanced condition would indeed cause the plate to rotate toward its open opposition. For the valve to remain closed under such conditions, an additional force must be imparted to the outside of the valve plate. From the expression $F_{m=(Fi-Fo)}/2.5$ where $F_m$ is the force required of the magnet, $F_o$ is the force outside the valve plate and $F_i$ is the force inside the valve plate, it will be thus determined that a magnet/striker combination should have a holding force of about 2.1 lbs.

Figure 2:
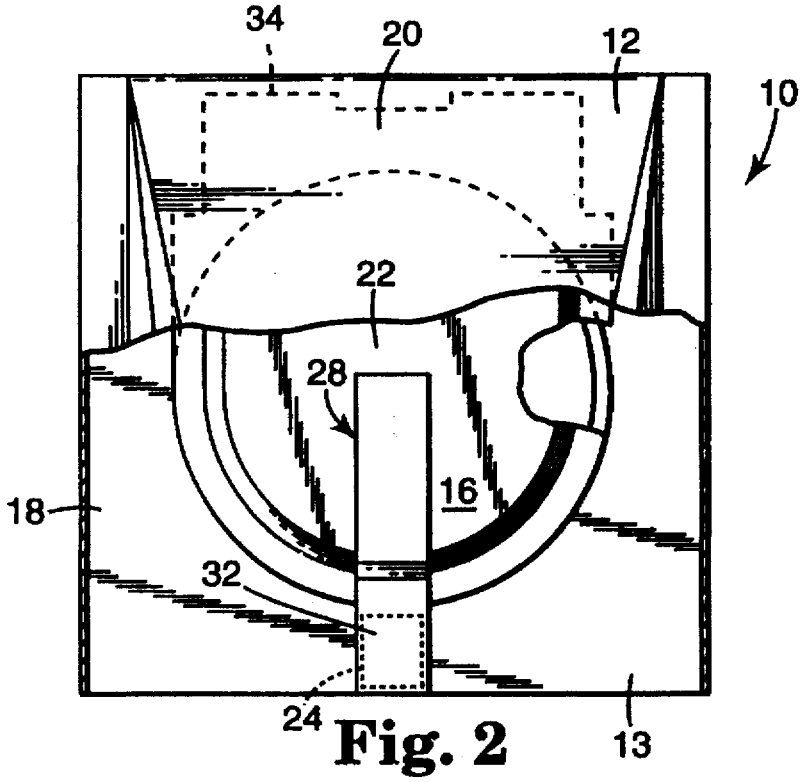
FIG. 2 is a partially broken away front view of the vent shown in FIG. 1.

In the partially broken away view of FIG. 2, the portion of the magnet 24 on the face plate 18 and of the striker plate 28 on the valve plate 22 is more clearly shown. Also, a hinge 34 for pivotally supporting the valve plate 22 is there shown.

Figure 3:
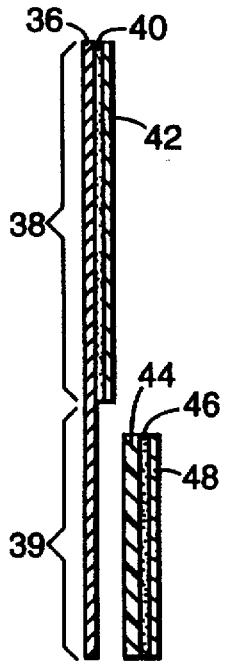
FIG. 3 is a side view of one embodiment of the magnetic latch of the present invention.
Figure 4:
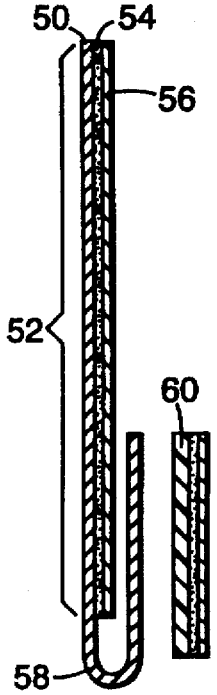
FIG. 4 is a side view of another embodiment of the magnetic latch of the present invention.

While the striker plate and associated magnet may have a variety of shapes, dictated only by the specific conjurations of the valve and face plates upon which they are mounted, preferred configurations of such combinations are shown in FIGS. 3 and 4.

In FIG. 3, a striker plate 36 is shown to consist of a flat strip of a magnetizable material, selected to be sufficiently thin so as to be readily bendable into a shape conforming with the shape of the valve plate upon which it is to be adhered. For example, a 0.5 inch wide, 3 inch long strip of 30 gauge (0.012 inch) galvanized tin-plated steel sheet of the type typically used in steel heating ducts may be preferred. To a first portion 38 of the striker plate 36 is secured a layer of pressure sensitive adhesive 40, and to the outside surface of the adhesive a length of suitable release liner 42 may be applied. Such an adhesive, with a release liner included is readily available as double coated carpet laying tape manufactured by Minnesota Mining and Manufacturing Company (3 M Co.), St. Paul Minn.

Also, the magnet 44 may comprise a piece, about 0.5 inch by 1 inch of a plastic bonded permanent magnet material sold under the brand name "plastiform"by the Arnold Engineering Company, Norfolk, Nebr. To one side of the magnet 44 is applied a layer of pressure sensitive adhesive 44, and to the remaining exposed face is applied a piece of suitable release liner 48. Such an adhesive may be provided by a layer of doubled coated tape, such as the carpet laying tape discussed above. Alternatively, an adhesive may be directly applied to one side of the magnet, such as a sprayed-on layer of type 77 spray adhesive also available from 3M Co. If such an adhesive surface is provided, and is to be used promptly, a release liner would then be unnecessary.

Figure 5:
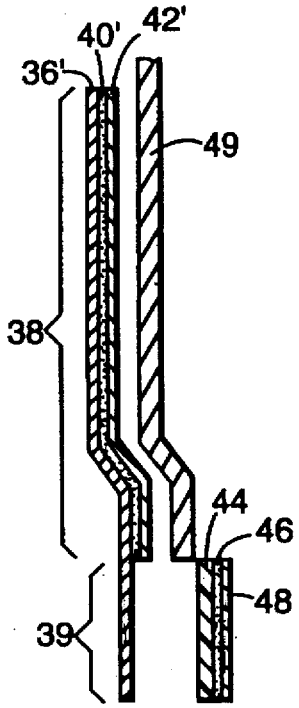
FIG. 5 is a cross sectional view of the embodiment shown in FIG. 2.

As also noted hereinabove, the magnetic latch is primarily intended for use in the after market. Thus, upon obtaining a latch such as shown in FIG. 1, it would be installed substantially as shown in FIG. 5. As there shown, a home owner or the like would inspect the valve plate 49 of a previously installed vent, and would bend the striker plate 36' so that the first portion 38' conforms to the valve plate 49. The remaining, vertical position, with the second portion 39' extending below the bottom edge of the valve plate. This bending and trial positioning of the striker plate is preferably done before the release liner 42' is removed. Once the desired position is determined, the release liner can then be removed, and the striker plate 36' lightly pressed in place.

The valve plate 49 may then be opened and magnet 44 may be placed in magnetic contact with the striker plate 36', with the adhesive layer 46 and associated release liner 48 facing outward. As the valve plate is allowed to pivot toward its closed position, the location at which the magnet 44 contacts the fixed face plate 18 will become apparent. And if that location appears to be suitable, the release liner 48 may be removed and the magnet 44 lightly pressed onto the face plate. The closure force thus provided on the valve plate may then be tested, both with and without blower expelled air present. If either the physical location of the respective members or the closure force are determined to be less than ideal, the striker plate and magnet may be removed from the valve plate and face plate and repositioned thereon until a desired location is located. The striker plate and magnet may then be firmly pressed onto their respective mating surfaces. The closure force may be further adjusted as necessary by modifying the gap between the striker plate and magnet, such as by placing one or more layers of weather resistant tape on the exposed surface of the magnet.

The embodiment of the latch shown in FIG. 4 is similar to that of FIG. 3, and the installation thereof on a vent would be substantially the same as well. In the embodiment of FIG. 4, however, while the striker plate 50 still includes a first portion 52 to which a layer of pressure sensitive adhesive 54 and associated release liner 56 is adhered, the second portion 58 of the plate 50 is bent back on itself into a U shape, so that the opposite surface of that plate faces the magnet 60 of the latch.

Figure 6:
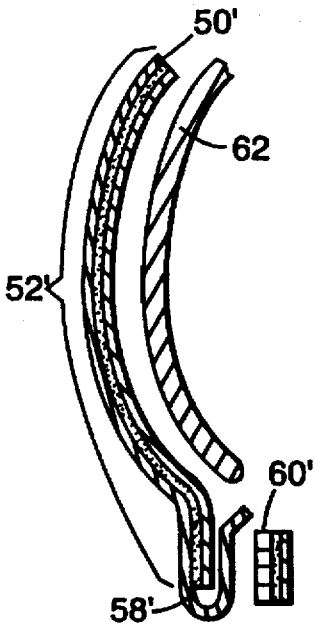
FIG. 6 is a cross section of an alternative installation of the latch of the present invention.

Upon installation, such as for example, on a vent formed of molded plastic in which the valve plate 62 is domed as shown in FIG. 6, the first portion 52' of the striker plate 50' would be gradually bent to conform to the domed shape of the valve plate 62. In such an embodiment, due to the greater thickness of the valve plate, the upper edge of folded-back second portion 58' may be slightly bent back to support the lower edge of the valve plate and may further be tightly crimped back on itself to further improve the mechanical steadfastness and the magnetic coupling between the striker plate and magnet.

While not specifically shown, it will be understood that a variety of alternative constructions may be employed within the scope of the present invention. For example, the magnet may include a plurality of alternating magnetic poles for still increased magnetic holding force. Also, the pressure sensitive adhesive layers may be in the form of a double coated adhesive tape, such as typically comprise a substrate with layers of pressure sensitive adhesive on opposing surfaces.

I claim:

1. A latch for use with an exhaust vent in which the vent comprises a fixed face plate on one side of which is an inlet for admitting air expelled from a blower, and on a directly opposite side of which is an air exhaust outlet for discharging such air into an outside atmosphere, and a valve for controlling the passage of air through the vent, said valve comprising a hingedly suspended valve plate operatively coupled to said exhaust outlet, said valve plate having an inside and an outside face, with the inside face presenting toward said fixed face plate and closing the valve by moving against said fixed face plate in the absence of blower expelled air, and said outside face communicating with said outside atmosphere, wherein said latch comprises at least one substantially flat plastic bonded magnet having a first face to which is bonded a layer of pressure sensitive adhesive and having an opposite second face for magnetic interactions, and an associated strike plate formed of a thin strip of a conformable magnetically susceptible material having a first portion to which is bonded a layer of pressure sensitive adhesive material, and having a second portion adapted to be magnetically engageable with and separable from said second face of the magnet, said first portion of the strike plate being adapted to be deformed to match the contour of either said fixed face plate or valve plate, and to be secured thereto by means of the pressure sensitive adhesive carried on the first portion while the second portion is positioned out of the airstream, and the magnet being adapted to be secured to the other of the valve plate or fixed face plate and to be appropriately positioned thereat by first magnetically coupling the second face of the magnet and second portion of the strike plate together and then by bringing the other of the fixed face plate or valve plate into contact with the adhesive carried on the magnet, thereby causing the other of the fixed face plate or valve plate to be secured to the magnet while ensuring that the magnet and strike plate are optimumly located with respect to magnetic attraction forces, said magnetic forces being operative in the absence of blower expelled air hold the valve in its closed position despite impulse torque imparted on the valve plate by pressure differentials resulting from gusts of wind to which the said outside face of the valve plate may be subjected, necessitating more intense impulse torques associated with more intense gusts before the valve will inadvertently open, while at the other extreme, the magnetic forces are sufficiently small as to be inoperative to hold the valve closed in the presence of blower expelled air.

2. A latch according to claim 1, wherein said magnet includes a plurality of alternating magnetic poles.

3. A latch according to claim 1, wherein said magnet includes a strip of magnetically responsive material secured to said first face and to the outer face of which the layer of pressure sensitive material is bonded.

4. A latch according to claim 1, wherein the outer surfaces of the adhesive layers carried by said magnet and associated strike plate are provided with release liners to facilitate handling and temporary positioning.

5. A latch according to claim 1, wherein at least one of said adhesive layers comprises a strip of pressure sensitive adhesive tape having adhesive on both sides of a substrate, the adhesive on one side thereby securing the tape to the respective latch member.

6. A latch according to claim 1, wherein said magnet is adapted to be adhered to a relatively planar surface of the fixed face plate out of the airstream and said strike plate is adapted to be bent to conform to the configuration of the valve plate and to extend therefrom to contact the magnet where it is adhered to the fixed face plate, thereby minimizing the mass added to the valve plate.

7. A latch according to claim 1, wherein the second portion of the strike plate is adapted to be bent back on itself and to be maintained thereat by the pressure sensitive adhesive layer, thereby allowing the valve plate to be positioned therebetween.

8. A latch according to claim 1, wherein said magnet comprises a piece of plastic bonded conformable material.

9. A latch according to claim 1, wherein a first face of said strike plate carries the layer of pressures sensitive adhesive and a second face is adapted to be separably engageable with the magnet.

10. A latch according to claim 1, wherein first face of said strike plate carries the layer of pressures sensitive adhesive and a portion of that face is adapted to be separably engageable with the magnet.

* * * * *